US005924149A

United States Patent [19]

Weber

[11] Patent Number: 5,924,149

[45] Date of Patent: Jul. 20, 1999

[54] THREE-POINT BRIDGE SUSPENSION END BEARING TRIFLEX FOR TRANSVERSE SLATS IN BED UNDERFRAMES AND USES THEREOF

[76] Inventor: Erhard Weber, Kloentrupstrasse 4, D-49082, Osnabrueck, Germany

[21] Appl. No.: 08/836,890

[22] PCT Filed: Nov. 18, 1995

[86] PCT No.: PCT/EP95/04541

§ 371 Date: Jul. 17, 1997

§ 102(e) Date: Jul. 17, 1997

[87] PCT Pub. No.: WO96/15699

PCT Pub. Date: May 30, 1996

[30] Foreign Application Priority Data

Nov. 22, 1994 [DE] Germany ..... 44 41 476

[51] Int. Cl.[6] ..... A47C 23/06

[52] U.S. Cl. ..... 5/238; 5/237

[58] Field of Search ..... 5/236.1, 238, 237, 5/191

[56] References Cited

U.S. PATENT DOCUMENTS

| | | | |
|---|---|---|---|
| 4,136,411 | 1/1979 | Fanti | 5/191 |
| 4,567,615 | 2/1986 | Fanti | 5/238 |
| 4,703,526 | 11/1987 | Degen | 5/237 |
| 4,752,981 | 6/1988 | Salens | 5/238 |

FOREIGN PATENT DOCUMENTS

| | | |
|---|---|---|
| 0 366 065 | 5/1990 | European Pat. Off. . |
| 0 575 721 A1 | 12/1993 | European Pat. Off. . |
| 2 670 101 | 6/1992 | France . |
| 39 32 340 A1 | 5/1990 | Germany . |
| WO 95/07644 | 3/1995 | WIPO . |

*Primary Examiner*—Brian K. Green
*Assistant Examiner*—Fredrick Conley
*Attorney, Agent, or Firm*—Foley & Lardner

[57] ABSTRACT

A three-point bridge suspension end bearing for transverse slats in a bed underframe includes a central spring element arranged centrally between two elastic bridge elements having eyes in their lower part. The eyes are rotatable about the axis of journals fixed to the underframe. The central spring element can be supported by a fixed or by a mobile support. Adjacent bridge elements can share the mount journals in a hinge-like partition of the rotatable eyes. Transverse slat caps can be incorporated in the top parts of the bridge elements with transverse connections to the central spring element or to the central spring element formed from bow-shaped segments. Transverse connections in collaboration with the bridge elements, or the tube chamber of a pneumatic sprung surface bearing, or a flexible/elastic belt, can be used as a mobile support, thus interactively coupling the three-point suspension end bearings.

9 Claims, 4 Drawing Sheets

Figure 1A:
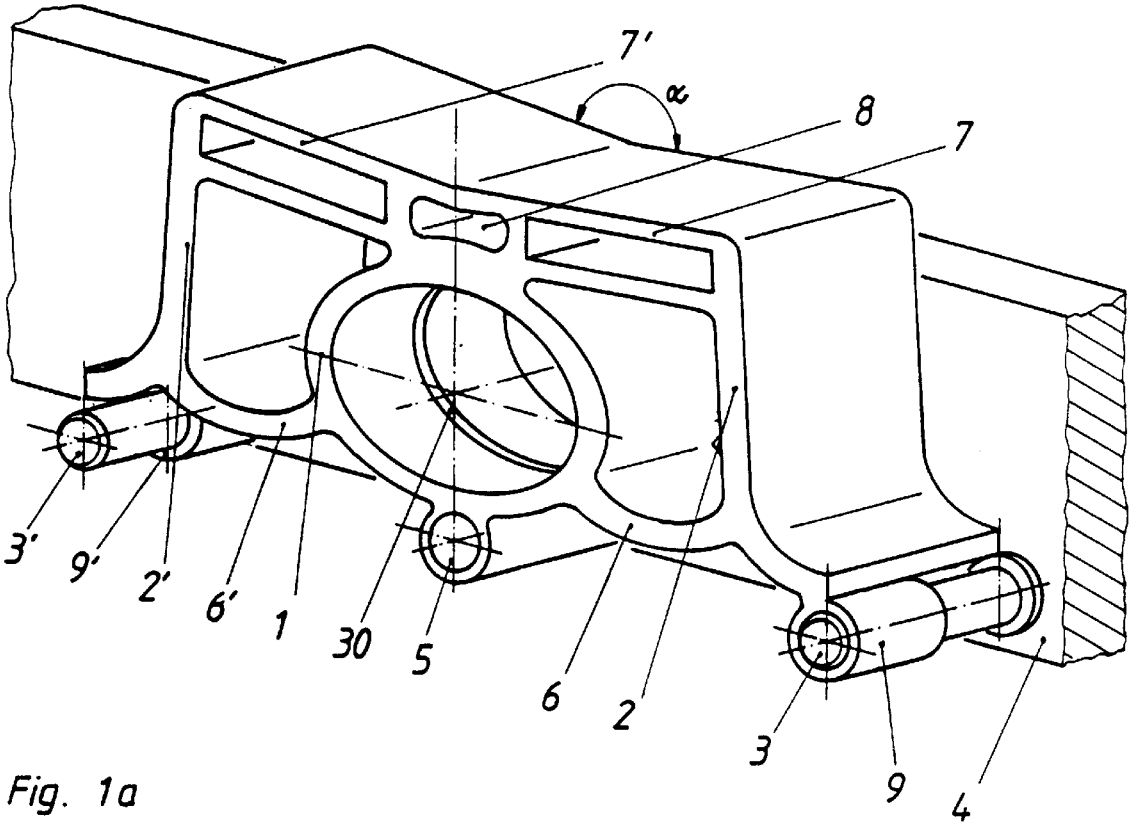

THREE-POINT BRIDGE SUSPENSION END BEARING TRIFLEX FOR TRANSVERSE SLATS IN BED UNDERFRAMES AND USES THEREOF

FIELD OF THE INVENTION

The invention concerns a three-point bridge suspension end bearing for flexible and inflexible transverse slats in bedframes with the special properties according to its construction:

I. An only slightly progressive adjustment stroke $h \approx H/2$ for a fixed support and $h \geqq H$ for a mobile support of the central spring element with H being the total construction height.

II. A large angular adjustment capability of the integrated transverse slat caps about the vertical center as well as a good lateral stability.

III. A sharing of the mount journals by neighboring bridge elements in a hinge-like toothing of the rotary eyes, as well as an integration of the transverse slat caps into the bridge elements or an axial junction to separate rotary slat caps.

IV. Largely variable adjustment to the weight distribution of the on-lying body.

V. Possible use as an element of large adjustment stroke resting on mobile supports like the pneumatic sprung surface bearing (PCT/EP 94/02772) or the flexible/elastic belt for interactively coupling several/all transverse slats.

DESCRIPTION OF THE RELATED ART

Normal end bearing made out of caoutchouc/plastic for transverse slats of bed underframes correspond to the two-point bearing on mount journals arranged in standardized drill holes of 60 mm, 64 mm, etc., distances. Various constructions are known with single or double bows and/or round or oval loops as flexible/elastic elements providing an adjustment stroke of 5 mm to a maximum of 20 mm.

Other two-point end bearings for single or double transverse slats have flexible necks for an angular adjustment of ±25°, thus having a very small vertical adjustment stroke. In the critical shoulder region, special adjustment elements are used which have strongly progressive (spiral-) spring elongations of 15 mm up to 25 mm and which are additionally inserted between the spar of the bed underframe and the transverse slat end caps, resulting in a shortening of the span of the transverse slats. Bridge elements comprising double caps without mount journals between two mounted end bearing elements are used for a lowering of the shoulder region.

The European patent application EP-A-0575721 discloses a two-point end bearing of which the upper supporting part is connected via a middle cross-piece to a footpart which makes it capable of swivelling. As to the construction, it differs completely from the end bearing described here, since it has no bridge elements.

The German patent application DE-A-3932340 is a two-point end bearing for three wooden transverse slats of which the three end caps are connected via cylindrical, elastic intermediate pieces to the two mount elements and to a cross-piece having an arched curvature.

The three end caps are each connected via bridges. The mount elements cannot rotate about the journals and a fixed bearing or the formation of a mobile bearing is not assigned.

The European patent application EP-A-0 366 065 describes a slat bearing element with a rhombic connecting framework which is inserted between a two-point mounting part fixed to the frame and a slat bearing part.

An additional tensile loaded spring connects free corner-points of the framework of an additional separate socket-line spring part is located in between.

At first sight, the examples, FIGS. 5(11) and 7, show, merely from the external appearance, a certain similarly to the end bearing Triflex; this is true also for the end bearing described in the French patent application FR 26 70 101.

In all three end bearings the two-point mount bearing, part consists of two transverse connections not capable of a rotation about the mount axes or of a transverse connection and a bow segment. Between the transverse connection there is a cap opening for a third slat or in the French application there is a eyelet for a reinforcement cross-slat over the bow segment. In the French application, the upper spring element consists of two arms formed like elbows on which two slat caps are seated spacially separated or connected by a bridge.

In the version, FIG. 5, of EP-A-0 366 065 a thick material arm is moulded in the middle between the additional spring part and the mount part which may become an elastic stop for the bearing part in case of a very large travel.

In not one of the given examples a central spring element can become a separate mobile support when loaded or can rest on a fixed or mobile support, a flexible belt or the pneumatic sprung surface bearing, since there is no (third) bearing support provided and since the possible vertical travel of the lower part of the central spring element is far too small for an efficient functioning of a mobile bearing.

The characterization of a three-point bridge suspension bearing according to the present invention is missing in all of the cited examples.

Not one construction example described in the cited documents has the additional degree of freedom of rotation about the mount axis claimed here which provides a new quality of deformation and therewith quantity of travel with $h \leqq H$ of the end bearing Triflex.

According to the state of art, not one of the known end bearings or transverse slat caps has more than two of the five stated properties each of the end bearing Triflex and not one reaches the adjustment travel capability claimed in point I or the possibility of use cited in pointed V.

SUMMARY OF THE INVENTION

The present invention aims at creating a transverse slat end bearing which fulfills all of the features cited in point I to V. The solution of the problem is achieved with the three-point bridge suspension end bearing for flexible or inflexible transverse slats in bed underframes.

The special properties I to V according to the invention are based on the following characteristics of the construction:

I. The variable coarse adjustment travel capability results from the flexible bridge elements cooperating with the spatially separated central spring element as well as from the possibility of installing or leaving out a fixed support. The bridge elements and, if necessary, the central spring element as well are connected with eyes which are rotatable about the axis of the mount journals.

The rotating capability of the bridge elements makes possible a smaller deformation of the elastic material as a function of the adjustment movement and thus a larger travel for smaller construction height compared to conventional end bearings. Thereby also a higher resistance to wear is achieved. Because of the routing capability, the spring effect becomes smaller than linearly progressive and thus yields a quicker and smoother coarse contour adjustment to the on-lying body.

The central spring element consisting of bow segments or cooperating with the transverse connection to the two symmetric bridge elements can take over the function of a mobile support thus making possible a stroke h≧H with H=total construction height of the end bearing. With the transverse connections installed, the adjustment is achieved the more easily the higher the connections are inserted.

II. The large angular adjustment is achieved by bending in the flexible bridge elements and by rotating the connected eyes about the mount journals; the good lateral stability results from the transverse connections to the central spring element or by constructing the central spring element from bow segments, respectively.

III. Because of the span of the end bearing Triflex the integration of double slat end caps in the upper part of the bridge elements is possible too without reducing its course travel adjustment capability. The usual hole pattern can be used for the mount journals of the bridge element and for the fixed support of the central spring element, if appropriate.

In the latter case and in the case of the special mobile support, two adjacent bridge elements of neighboring end bearings advantageously share two by two the mount journals attached to the bed frame with a hinge-like toothing of the eyes, giving a good mount even for the envisages rotation.

The mount and supporting points can be placed to or under the lower brim of the bed underframe by means of excentric plug connections.

In the case of the pneumatic sprung surface being with a tube-container in a U-profile shaped spar serving as a mobile bearing it may be advantageous to connect separate rotatable double transverse slat end caps with the bridge suspension end bearing via an axle of rotation. In this way said axle can sink into an appropriate cut in the inner side of the U-profiled spar thus providing the full travel capability (h>H) of the mobile tube-container support without increasing the total construction height.

IV. The very variable individual adjustment to the weight and the weight distribution in the regions of the shoulders and of the pelvis, in particular, can be achieved by

- inserting or removing a fixed support for the central spring suspension element
- inserting or clicking suitable reinforcement elements into the openings of the central spring-, the bridge-, or the transverse connection elements of a Triflex end bearing.

The individual adjustment can be achieved with the help of a measuring system for the pressure load applied.

V. Utilizing its large travel capability, Triflex end bearings can especially advantageously be used with the two special mobile end bearings, the pneumatic spring surface bearing as well as the elastic belt support, to interactively couple the end bearings.

In both cases an adjustment travel of h≧H is achieved.

The end bearing Triflex can, in particular, be used for highly comfortable transverse slat under-frames with flexible spring wooden slats or inflexible transverse slats. It provides a decisively improved quality of lying compared with conventional end cap bearings especially in the regions of the shoulders and the spine when a human body is lying on its side, or in the regions of the back, the nape of the neck or of the head when lying on its back. The use of additional shoulder adjustment elements is completely dispensable. In all cases the thickness of the mattress support can be reduced to 80 to 100 mm which will ensure the adjustment capability and will improve the cross ventilation.

The end bearing Triflex can also be used for sick-beds as well as comfort-couches with or without mattress supports. In the latter case, it is possible to use a direct connection or a material compound of the (plastic) end bearings and the transverse slats.

The combination of the end supports Triflex with the two special mobile bearings, see above, to interactively couple all end bearings together with the transverse slats, results in an as yet unreached comfort of lying with an optimal adjustment and a positive support acting in all lying positions.

IN THE DRAWINGS

The accompanying drawings illustrate the most important parts and functions of the end bearing Triflex. They show the principle construction in a schematic way and present in each case only one out of several construction possibilities and uses.

FIG. 1*a:* Principle construction of a three-point bridge suspension end bearing with integrated end caps 7,7' for double transverse slats and a fixed or mobile support 5.

Figure 1B:
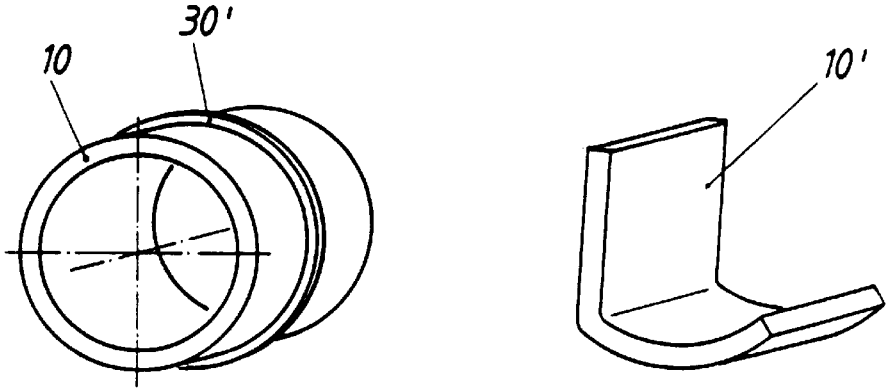

FIG. 1*b:* Insertable reinforcement elements 10 and 10'.

Figure 2A:
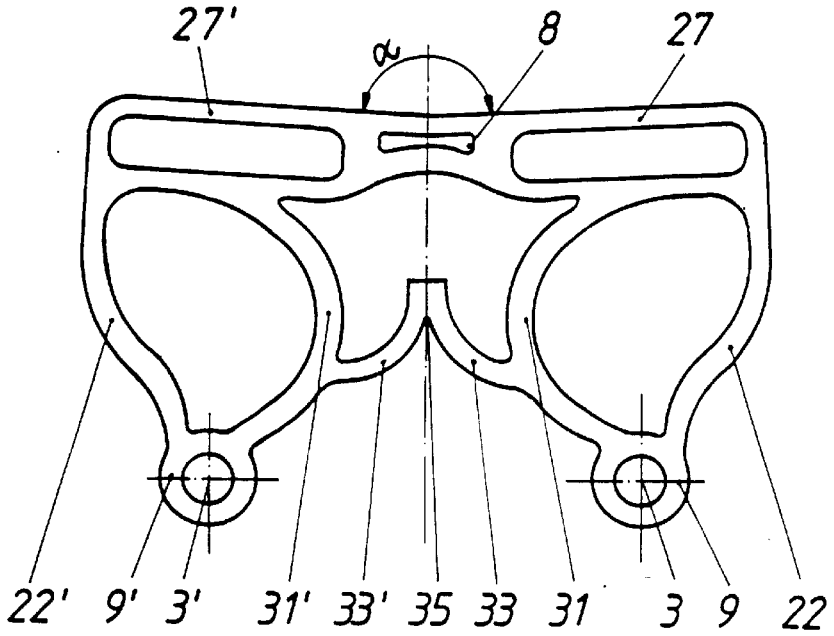

FIG. 2*a:* Cross section of a three-point bridge suspension element with mount eyes 9,9' which can rotate inwardly and with a central spring element consisting of two bow segments 31,31' and 33,33' which combine to a moving support 35 in the middle.

Figure 2B:
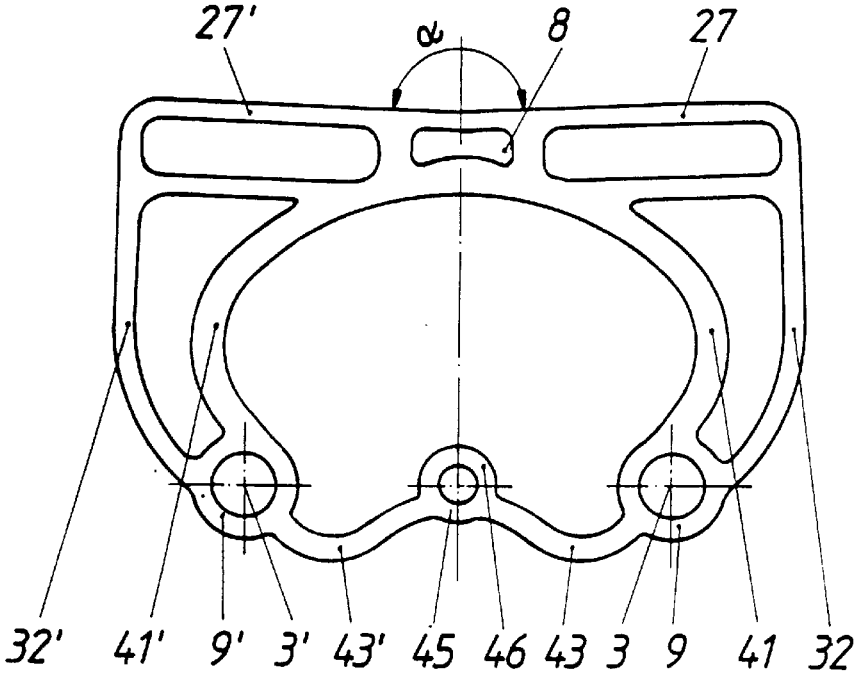

FIG. 2*b:* Cross section of a Triflex end bearing with mount eyes 9,9' which can rotate outwardly, and whose central spring element consists of bow segments 41,41' and 43,43'.

Figure 3:
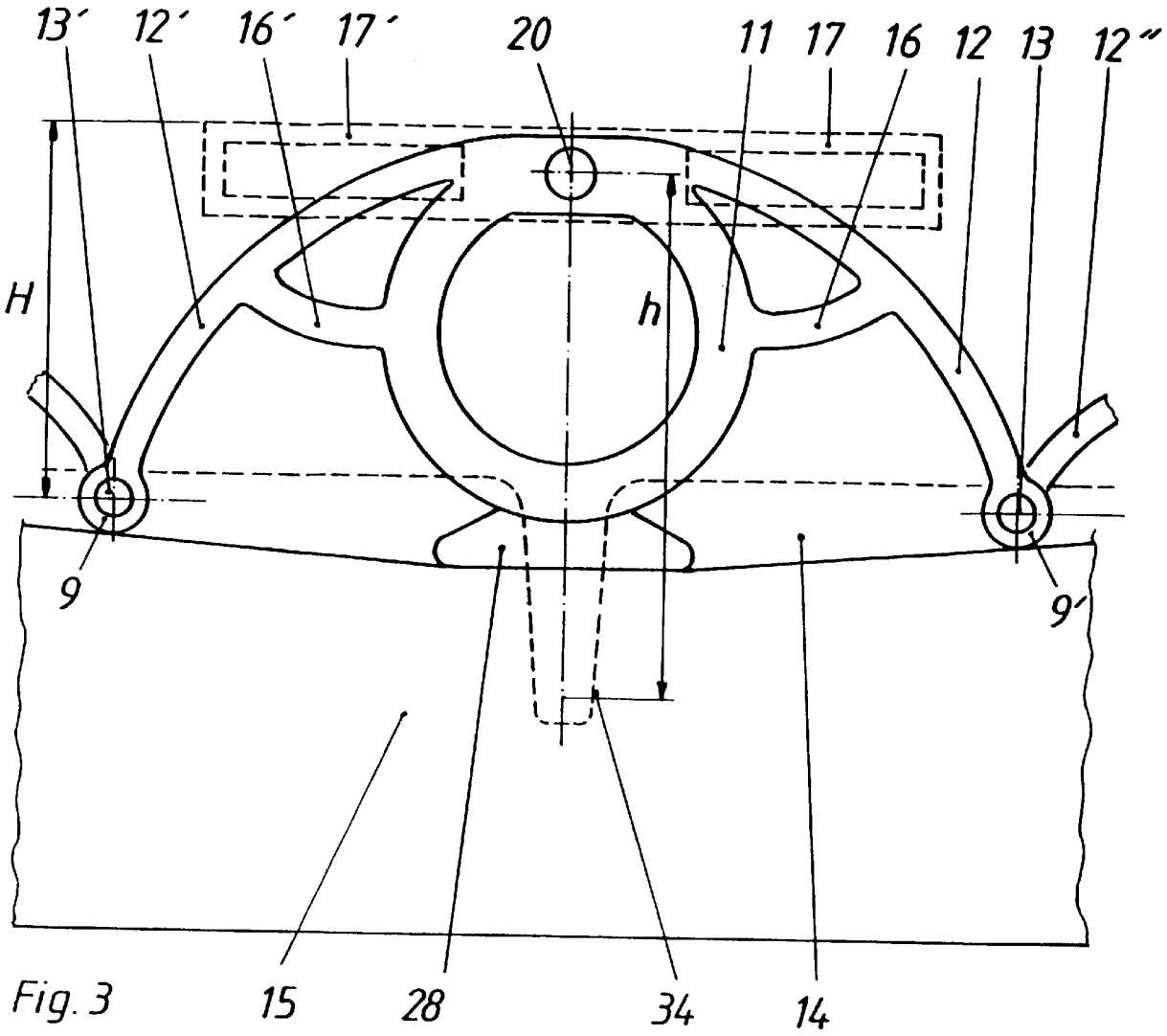

FIG. 3: Cross section of a three-point bridge suspension end bearing with separate double transverse slat end bearings 17,17' and a mobile support consisting of the tube container 15 of a pneumatic spring surface bearing.

Figure 4A:
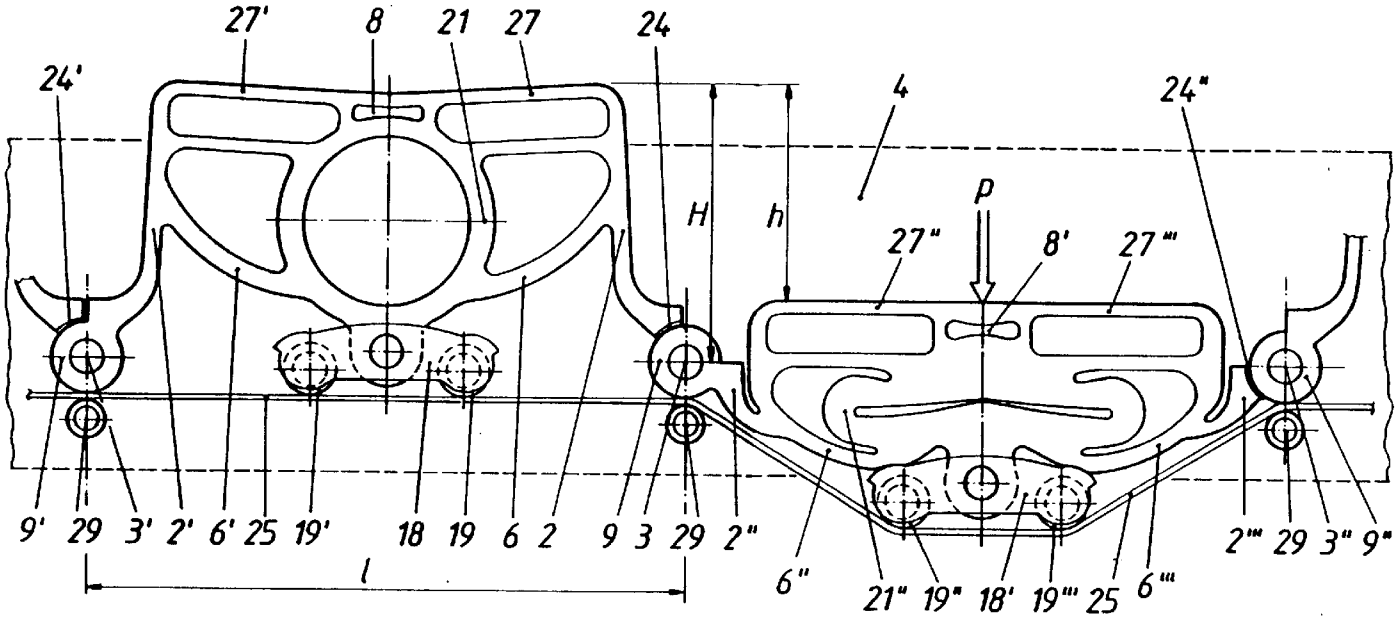

FIG. 4*a:* Cross section of two Triflex end bearings in an unloaded and in a loaded condition with a flexible belt 25 as mobile support.

Figure 4B:
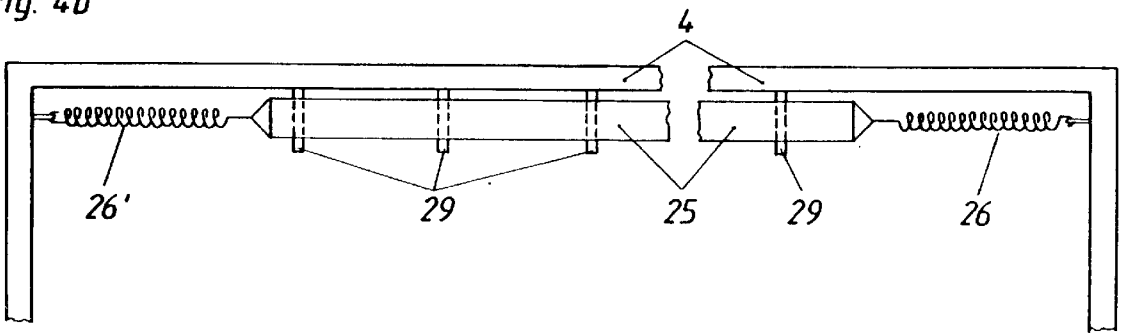

FIG. 4*b:* The view onto a bed underframe 4 part with the flexible belt 25 as mobile support and two spiral springs 26,26' as elongation elements.

DETAILED

FIG. 1*a* shows a three-point bridge 2,2' suspension end bearing with the mount journals 3,3' fastened to the spar 4 of a bed underframe. The central spring element 1 has a notch 30 for clicking in the reinforcement elements 10 (FIG. 1*b*) and can be fastened as well to the spar 4 by means of a mount eye 5 as a fixed support.

The mount eyes 9,9' are pivoted rotatably on the journals 3,3' in a hinge-like partition two by two. Adjacent bridge elements 2,2' etc., see also FIG. 4*a,* can share the mount journals 3,3'.

The transverse slat caps 7,7' are advantageously integrated in the upper part of the bridge elements 2,2' and can form an obtuse angle close to and <180° for the unloaded condition. When loaded, the deformation to an angle ≧180° is possible and facilitated by a punctured hole 8. Transverse connections 6,6' between the central spring element 1 and the bridge elements 2,2' provide a guided adjustment stroke, by bending in the bridge-2,2' and the connection elements 6,6' and provide a good lateral stability.

FIG. 1*b* shows two possible reinforcement elements 10,10' which may be clicked or inserted in the central spring element 1 or in between the bridge-2' and the transverse connection elements 6' for an (individual) adjustment to the weight or the weight distribution of the bed user. The bar 30' clicks into the notch 30 at the same time.

FIG. 2 a shows a three-point bridge 22,22' suspension end bearing with integrated end caps 27,27' for two transverse slats and with the central spring element consisting of two large symmetric bow segments 31,31'. A moving support 35 is located in the middle of said segments which is formed out of two converging smaller bow segments 33,33'. The mount eyes 9,9' terminate the lower parts of the bridge elements 22,22' and the bow segments 31,31' can rotate about the mount journals, in this way providing a continuous inward deformation of the elements 31,31' and 22,22'. In cooperation with the bow segments 33,33' which form the moving support 35, an adjustment rise of $h \geqq H/2$ is achieved. For the angular adjustment the moving support 35 takes over the function of a stop in leaning against the large bow segments 31,31', thus terminating the angular deflection. This end bearing has a large, well-balanced stroke and angular adjustment together with a good resting capability and lateral stability.

In FIG. 2*b*, a three-point bridge suspension end bearing is shown with integrated cross-slat end caps 27,27' and with the possibility of an outward, continuous deformation of the bridge elements 32,32' and of the bow segments 41,41' and 43,43' of the central spring element. This possibility is provided by the rotation of the mount eyes 9,9' about the mount journals 3,3'. The mobile or fixed support 43 has a stabilizing function for the angular adjustment.

In case the support 45 is used only as a mobile one, the eye 46 can advantageously be skipped.

In this version, an adjustment stroke of $h \approx H/2$ can be achieved for the fixed bearing and of $h=2H/3$ for the mobile support 45. The angular adjustment is also larger than in the version shown in FIG. 2*a* for the case of the mobile support but at the cost of lateral stability.

In FIG. 3 the cross section of a three point bridge 12,12' suspension end bearing is shown with separated end caps 17,17' for two transverse slats. The end caps 17,17' can rotate about an axle 20 located in the middle over the central spring element 11. A flat surface support element 28 rests on the tube like container 15 as a mobile bearing of a pneumatic sprung surface bearing; here the side spar 14 of the bed underframe consists of a U-profile receiving the tube filled with an incompressible medium. The mount journals 13,13' are connected to the upper part of the U-profile. The journals 13,13' can be riveted to or be screwed into the two sides of U-profile spar 14 and thus add to the twisting stability of the bed frame spars.

Transverse connection 16,16' located in the upper half of the bridge elements 12,12' ensure, when pressure is applied, an easy, guide stroke of the connecting axle 20 and of the separated end caps 17,17' under the mount journals 13,13' with the axle 20 descending into the cut 34 of the inner side of the U-profile and thus deforming the tube container 15 as well as the central spring element 11 to more or to approximately half of their heights in the unloaded condition, respectively.

Thereby, a total stroke of $h \geqq H$ of the bridge suspension end cap is achieved.

The stroke movement is mainly achieved by means of the rotation about the axis of the journals 13,13' and by the elastic deformation of the central spring element 11 and of the bridge elements 12,12'. The good lateral stability (in direction of the spars) is due to the transverse connections 16,16' remaining fairly constant in length when elastically deformed. The resetting into the unloaded, normal condition, shown in FIG. 3, results from the elasticity of the end bearing under deformation, in particular, of the central spring element 11, and from the pressure and height adjustment of the tube container 15.

For the bridge suspension end caps materials can be used which are durably elastic under deformation like caoutchouc, vulcanized EPDM rubber, as well as (plastic) materials like polyurethane foams or SEBS (Styrol-Ethylen-Butadien-Styrol). A small hysteresis and remanence under deformation of the materials is desirable.

In case of the transverse slat end caps integrated in the bridge elements 2,2' those caps may be made out of somewhat harder plastic materials and may pass seamlessly into the plastic bridge 2,2' and the central spring elements 1,21. Such compound material techniques are widely used today.

The separate end caps 17,17' consist advantageously of harder (plastic-) materials which are negligibly or slightly subject to a twisting deformation; if needed, a gliding busing may be used to ensure the rotation about the connecting axle 20. The axle can consist of metal, Al, brass or steel or of deformation-resistant plastics with a fiber filling, if appropriate.

In FIG. 4*a* the cross section of two bridge suspension end caps with integrated transverse slat end caps 27,27' and 27",27"' is shown with a common flexible mobile belt support 25, in one case in an unloaded condition and in the other case in a strongly pressure p loaded condition. Neighboring bridge elements 2,2" share the same mount journals 3 (3', etc). Here the support elements 18, 18' are advantageously carriages with double rolls 19,19', and 19",19"40 which can move over the flexible elastic belt.

The belt 25 rolls on roll bushings 29 which are in this version connected to the underframe spar 4 under the mount journals 3,3',3". The carriage with the double axle 18,18' is advantage compared to one with one axle since it provides a more uniform and deeper stroke with a lower loading of the belt 28 in spots.

Advantageously the carriage has a roof over the rolls 19,19' which prevents the transverse connections 6,6', etc., and the central spring element 21,21', respectively, from touching down onto the rolls and thus impeding a further rolling on the belt 25.

The bridge elements 2,2',2" share in a hinge-like two by two partition the mount journals 3,3',3" about which the mount eyes 9,9',9" can rotate. A cut 24,24',24" out of the shoulder of the overlapping bridge elements facilitates the rotation.

FIG. 4*b* shows the view onto an arrangement of a flexible belt 25 ranging over approximately 90% of the lenght of the bed under frame spar 4 and resting on the roll-business 29; the 25 is connected to a spiral spring 26,26' on each the head- or foot-part of the frame serving as elastic elongation elements.

The hardness of the spiral springs can individually be adjusted to the weight of the on-lying body. Hardened spiral springs show when loaded only in their elastic range practically no sign of fatiguing.

The bridge suspension end caps located between the roll bushings 29 are not shown.

For the belt, approximately 20 to 30 mm wide and 1 to 2 mm thick, it is suitable to take webs out of natural fibers or woven plastic fibers or flexible, elongation resistant plastic material. For the flexible, elongation elastic belt, e.g., caoutchouc, vulcanized rubber species or comparably elastic and flexible plastic materials can be used.

A less than linearly progressive dependence of the change of the pulling force on the elongation Δl is achieved by means of the cooperation of the end bearings with the flexible (elastic) belt arrangement, see FIG. 4*a*.

The Hooke law for the elastic expansion of the elongation elements 26,26' (or the elastic belt itself) is $$\Delta F = -D \cdot n \cdot \Delta l \tag{1}$$

with n=the number of the end bearing segments and D=the elastic (spring) constant. It can be shown by a simple geometric consideration that the vertical displacement Δh of the belt is to a good approximation proportional to the square root of the elongation Δl of the straight lenght l of the belt between two roll bushings 29.

For the case of Δh<⅓

$$\Delta h \approx (\Delta l \cdot ½)^{1/2} \tag{2}$$

is valid.

Δl from equation (2) inserted in (1) results in $$\Delta F = -D \cdot n \cdot (\Delta h / 1/2)^2 \cdot 1/2 \tag{3}$$

With the presumption Δh>⅓ the factor becoems (Δh/½)>1; thus for the elongation force to the vertical displacement relation (3) a decisive reduction is achieved compared to the linear progressive dependence, in particular, during the coarse adjustment phase.

Examples of the displacement Δh under the equilibrium height of the belt 25 with l=128 mm show the smaller than linear increase in elongation of:

$$\Delta 1 = (\Delta h/1/2)^2 \cdot 1/2 \tag{4}$$

| | | | | |
|---|---|---|---|---|
| Δh/mm | 10 | 20 | 30 | 40 |
| $(\Delta h/1/2)^2$ | 0,02 | 0,1 | 0,22 | 0,39 |
| Δl/mm | 1,6 | 6,2 | 14 | 25 |

The result is an at first slowly progressive coarse contour adjustment of several end bearings together with the connecting transverse slats to the on-lying body and their interactive coupling via the common support belt 25.

The plotted negative stroke h for a pressure p load can by all means reach the construction height H of the end bearing.

The rolls 29 fixed to the frame and the roll bushings 19,19' of the carriage with the double axle ensure that the belt is loaded (extended) largely uniformly on its total length and is not exposed to an excessive load in the region of individual end bearings.

The interactive coupling of all or more than 90% of the end bearings and their large total stroke of h≈H renders possible:

- a springy accommodation free of pressure peaks of the on-lying body on its back or on its side
- a very good support of the regions of the back vertebras, the nape of the neck and of the thighs when lying on the back or of the hip and of the head regions when lying on the side, respectively.
- the use of a mattress support, only 80 to 100 mm thick, of good adjustment capability and cross-ventilation.

The accommodation capability of the mattress support and of the elastic transverse slats, respectively, add to the cited stroke of the innovative end bearing.

The interactive coupling, in particular, of the end bearings and of the transverse slats covering all of or at least more than 90% of the bearing surface of the bed underframe results in an effective support of the vertebral column and in a weight relieving lying comfort. This comfort can absolutely be compared with that achieved with the pneumatic sprung surface bearing according to FIG. 3 and the PCT/EP94/02772 application.

What is claimed is:

1. A three-point bridge suspension end bearing for transverse slats in a bed underframe having mount journals, comprising:

eyes rotatably engageable into the mount journals;

two elastic bridge elements connected to the eyes;

a central spring element connected to the two elastic bridge elements; and a mount eye connected beneath the central spring element, such that the mount eye is positioned before the eyes, wherein the eyes are positioned at a lower part of the bridge elements and are rotatable about the axis of the mount journals, and wherein the central spring element is supported by the mount eye under load.

2. A three-point bridge suspension end bearing according to claim 1, wherein the bridge elements have at least one transverse connection coupled to the central spring element, wherein the bridge elements and the at least one transverse connection consist of deformation-elastic materials.

3. A three-point bridge suspension end bearing according to claim 1, wherein the central spring element consists of bow segments which are located between an upper part of the bridge elements and the eyes or between the eyes, and wherein the central spring element is formed as one of a ring, a trapezoid, a double trapezoid, a rhombus, a rectangle, and an X-shape.

4. A three-point bridge suspension end bearing according to claim 1, further comprising a second three-point suspension end bearing also adapted to be connected to the bed underframe and adjacently positioned with respect to the three-point bridge suspension end bearing, the second three-point suspension end bearing including two elastic bridge elements, wherein one of the two bridge elements of the three-point bridge suspension end bearing element share one of the mount journals.

5. A three-point bridge suspension end bearing according to claim 1, the upper part of the bridge elements are in the form of one of single and double transverse slat caps.

6. A three-point bridge suspension end bearing according to claim 1, further comprising:

matching reinforcement elements adapted to be inserted or clicked into one of a) the central sprig element and b) the bridge and the transverse connection elements.

7. A three-point bridge suspension end bearing according to claim 5, wherein the end bearing includes two compound materials, one being elastic under deformation for the transverse slat caps and one being inelastic under deformation for the bridge elements and the central spring element and wherein the end bearing is molded to the transverse slat caps or forms a material compound with the transverse slat caps.

8. A three-point bridge suspension end bearing according to claim 1, further comprising:

an axle located above the central spring element in a substantially middle portion of the three-point bridge suspension end bearing, wherein the axle provides a rotatable connection to separate transverse slat caps.

9. A three-point bridge suspension end bearing for transverse slats in a bed underframe having mount journals, comprising:

eyes rotatably engageable into the mount journals;

two elastic bridge elements connected to the eyes;

a central spring element connected to the two elastic bridge elements;

a belt disposed under the central spring element; and a surface support element located under the central spring element and above belt, the surface support element adapted to rest on belt, wherein the surface support element becomes a mobile support for the central spring element when the central spring element is under load, and wherein the eyes are located in a lower part of the bridge elements and are rotatable about the axis of the mount journals.

* * * * *